US008491354B2

(12) United States Patent
Kipp

(10) Patent No.: US 8,491,354 B2
(45) Date of Patent: Jul. 23, 2013

(54) DRY ICE BLASTING DEVICE

(76) Inventor: Jens Werner Kipp, Bielefeld (DE)

( * ) Notice: Subject to any disclaimer, the term of this patent is extended or adjusted under 35 U.S.C. 154(b) by 428 days.

(21) Appl. No.: 12/744,562

(22) PCT Filed: Dec. 9, 2008

(86) PCT No.: PCT/EP2008/010449

§ 371 (c)(1),
(2), (4) Date: May 25, 2010

(87) PCT Pub. No.: WO2009/074294

PCT Pub. Date: Jun. 18, 2009

(65) Prior Publication Data

US 2010/0261416 A1 Oct. 14, 2010

(51) Int. Cl.
*B24C 5/00* (2006.01)

(52) U.S. Cl.
USPC ..... 451/91; 451/101; 451/102

(58) Field of Classification Search
USPC ..... 451/91, 99–102, 38–40, 90
See application file for complete search history.

(56) References Cited

U.S. PATENT DOCUMENTS

| | | | | | |
|---|---|---|---|---|---|
| 3,716,190 | A | * | 2/1973 | Lindlof | 239/2.2 |
| 4,633,623 | A | * | 1/1987 | Spitz | 451/102 |
| 4,817,342 | A | * | 4/1989 | Martin et al. | 451/90 |
| 5,125,979 | A | | 6/1992 | Swain | |
| 5,320,289 | A | * | 6/1994 | Hashish et al. | 239/434 |
| 5,335,459 | A | * | 8/1994 | Dale | 451/102 |
| 5,876,267 | A | * | 3/1999 | Kanda | 451/38 |
| 6,932,285 | B1 | * | 8/2005 | Zeng | 239/589 |
| 7,708,620 | B2 | | 5/2010 | Kipp | |
| 7,967,664 | B2 | * | 6/2011 | Elbing et al. | 451/91 |

FOREIGN PATENT DOCUMENTS

| | | | |
|---|---|---|---|
| DE | 10243855 | A1 | 4/2004 |
| DE | 20310119 | U1 | 5/2004 |
| DE | 20310119 | U1 | 6/2004 |
| DE | 20311771 | U1 | 12/2004 |
| DE | 20318056 | U1 | 4/2005 |
| DE | 202005018953 | U1 | 4/2007 |
| EP | 1501655 | B1 | 4/2006 |
| JP | 2557383 | | 8/1997 |
| JP | 2005-111575 | | 4/2005 |
| JP | 04-253331 | | 9/2012 |
| WO | 2004/033154 | A | 4/2004 |
| WO | 2006/005377 | A1 | 1/2006 |
| WO | 2007/125565 | A | 11/2007 |

* cited by examiner

*Primary Examiner* — Dung Van Nguyen
(74) *Attorney, Agent, or Firm* — Richard M. Goldberg

(57) ABSTRACT

A blasting device includes a flow passage (14) for a carrier gas, the flow passage (14) forming a blasting nozzle (12) at its downstream end, and a supply line (22) for liquid CO2, the supply line opening out into an expansion chamber (26) that is coaxially accommodated in the flow passage (14), the expansion chamber (26) being formed by a pipe (20) that is held at its upstream end by a holder (18) which is passed by the flow of carrier gas in the flow passage, and in that the supply line (22) extends through the holder (18) in transverse direction of the flow passage and opens into an expansion valve (24) that extends in parallel with the axis of the flow passage (14).

14 Claims, 2 Drawing Sheets

DRY ICE BLASTING DEVICE

BACKGROUND OF THE INVENTION

The invention relates to a blasting device comprising a flow passage for a carrier gas, the flow passage forming a blasting nozzle at its downstream end, and a supply line for liquid $CO_2$, the supply line opening out into an expansion chamber that is formed coaxially in the flow passage.

EP 1 501 655 discloses a blasting device wherein the expansion chamber enters laterally into the flow passage. As an alternative, the possibility has been mentioned that the expansion chamber may be accommodated coaxially in the flow passage.

The expansion and evaporation of a part of the liquid $CO_2$ in the expansion chamber produces evaporation chill, so that another part of the $CO_2$ condenses to solid dry ice which then serves as a blasting medium that is carried along with the carrier gas and accelerated in the blasting nozzle. Such a device is suitable for efficiently and yet gently removing incrustations from surfaces. The cleaning effect depends critically on the number, size and velocity of the $CO_2$ particles.

SUMMARY OF THE INVENTION

The invention with the features indicated in the independent claims solves the problem to achieve high yield of solid $CO_2$ and a high cleaning effect by efficient coagulation and acceleration of the solid $CO_2$ by means of a compact device and by with a reduced consumption of carrier gas.

Useful details of the invention are indicated in the dependent claims.

BRIEF DESCRIPTION OF THE DRAWINGS

An embodiment example will now be described in conjunction with the drawings, wherein.

DETAILED DESCRIPTION

Figure 1:
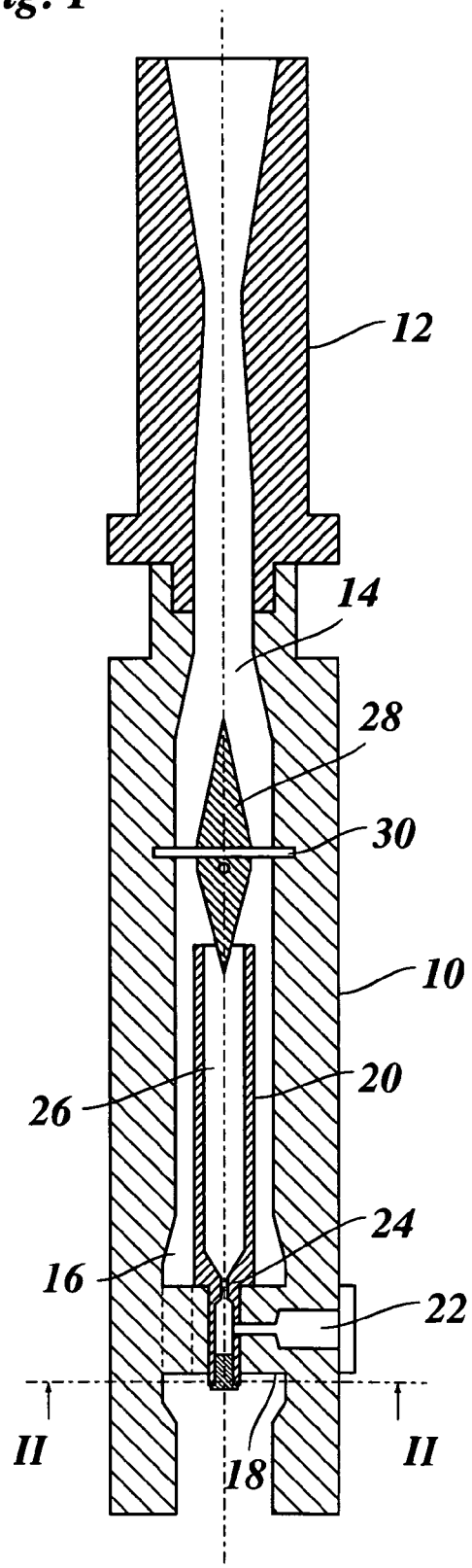
FIG. 1 is an axial section of a blasting device according to the invention.

A blasting tube 10 carries at its downstream end, i.e. the upper end in FIG. 1, a blasting nozzle 12, e.g. a convergent/divergent nozzle, preferably a Laval nozzle. Together, the blasting tube 10 and the blasting nozzle 12 form a flow passage 14 for a carrier gas, e.g. compressed air, which is supplied at a relatively low pressure as compared to conventional devices, e.g. at a pressure of only 0.05 MPa. In the blasting nozzle 12 the compressed air is accelerated to approximately sonic speed or supersonic speed.

A portion of the straight flow passage 14 inside the blasting tube 10 is enlarged to form an annular space 16 which accommodates a holder 18 for a pipe 20 that is arranged coaxially in the flow passage. The supply line 22 for liquid $CO_2$ is formed near or preferably inside of the holder 18 and extends in transverse direction of the flow passage 14. The supply line 22 opens, via an injection passage 24 that extends in parallel with the axis of the flow passage 14, into an expansion chamber 26 formed inside a pipe 20. There, the liquid $CO_2$ that is preferably supplied at a pressure of 1 MPa or more is expanded and evaporated, so that a part of the $CO_2$ which may amount to approximately 40-60% of the total amount of $CO_2$ may condense to solid dry ice. The injection passage 24 and the expansion chamber 26 extending coaxially in the flow passage 14 cause the dry ice to be introduced into the flow of carrier gas with already a relatively high initial speed in flow direction of the carrier gas, so that the dry ice will be further accelerated to high speed by the carrier gas and will also be evenly distributed in the flow passage 14.

In the example shown, there is provided only a single injection passage 24 centered onto the axis of the flow passage 14.

The cross-sectional area A of the injection passage 24 and the volume V of the expansion chamber 26 fulfil the relation $V^{1/3}/A^{1/2}>3$, preferably $V^{1/3}/A^{1/2}>10$.

Downstream of the pipe 20, the flow passage 14 has accommodated therein a squeeze body 28 that is shaped as a double cone. In general, the squeeze body should have a streamline configuration, i.e. should be tapered towards both, its front and rear ends.

In the example shown, the squeeze body 28 projects slightly into the expansion chamber 26 with its upstream tip end, so that it forms an annular gap with the walls of the pipe 20. Moreover, the downstream tip end of the squeeze body projects slightly into a conical portion of the flow passage 14 shortly before the entry into the blasting nozzle 12.

The squeeze body 28 has the purpose to maintain the pressure in the expansion chamber 26 at suitable values and thereby to assist in the coagulation of the dry ice in the expansion chamber. At the same time, the squeeze body assures a better distribution and acceleration of the dry ice in the compressed air in the flow passage and a further growth of the $CO_2$ particles, while avoiding on the other hand that the constrictions between the pipe 20 and the squeeze body and/or between the squeeze body and the walls of the flow passage 14 become clogged by the formation of ice.

Figure 2:
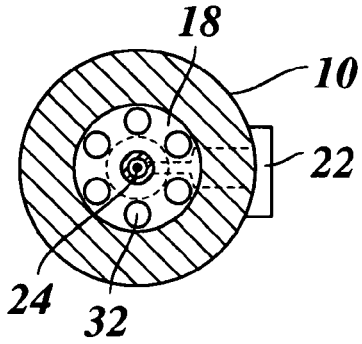
FIG. 2 shows a cross-section taken along the line II-II in FIG. 1.

As is shown in FIG. 2, the holder 18 has such a construction that it permits the passage of the carrier gas. In the example shown, this is achieved by a crest of holes 32 that are arranged around the cross-section of the pipe 20. It is also possible, however, that the holder is configured as a cross or star the arms of which may be streamlined.

The blasting device that has been disclosed herein has the important advantages that the low pressure of the carrier gas permits a low consumption of carrier gas which may for example amount to less than 0.1 $m^3$/min, as compared to at least 0.8 $m^3$/min for conventional dry ice blasting devices. Further, the construction and arrangement of the injection passage 24 and the expansion space 26 and the squeeze body 28 permit to achieve a high yield of solid $CO_2$ and a high quality (size and hardness) of the $CO_2$ particles, which results in a high cleaning effect.

In the example that has been shown herein, the flow passage 14 is slightly tapered in the blasting tube 10 upstream of the blasting nozzle 12, but the mouth of the expansion chamber 26 is located in a position (at least 30 mm ahead of the nozzle constriction) in which the cross-sectional area of the flow passage 14 amounts to at least 1.5 times the cross-sectional area of the constriction of the blasting nozzle 12.

The blasting tube 10 may be surrounded by a heat insulating layer. However, a certain protection against icing is achieved already by the fact that the expansion chamber 26 is arranged coaxially in the flow passage and is therefore surrounded by an annular gap through which the compressed air passes.

Figure 3:
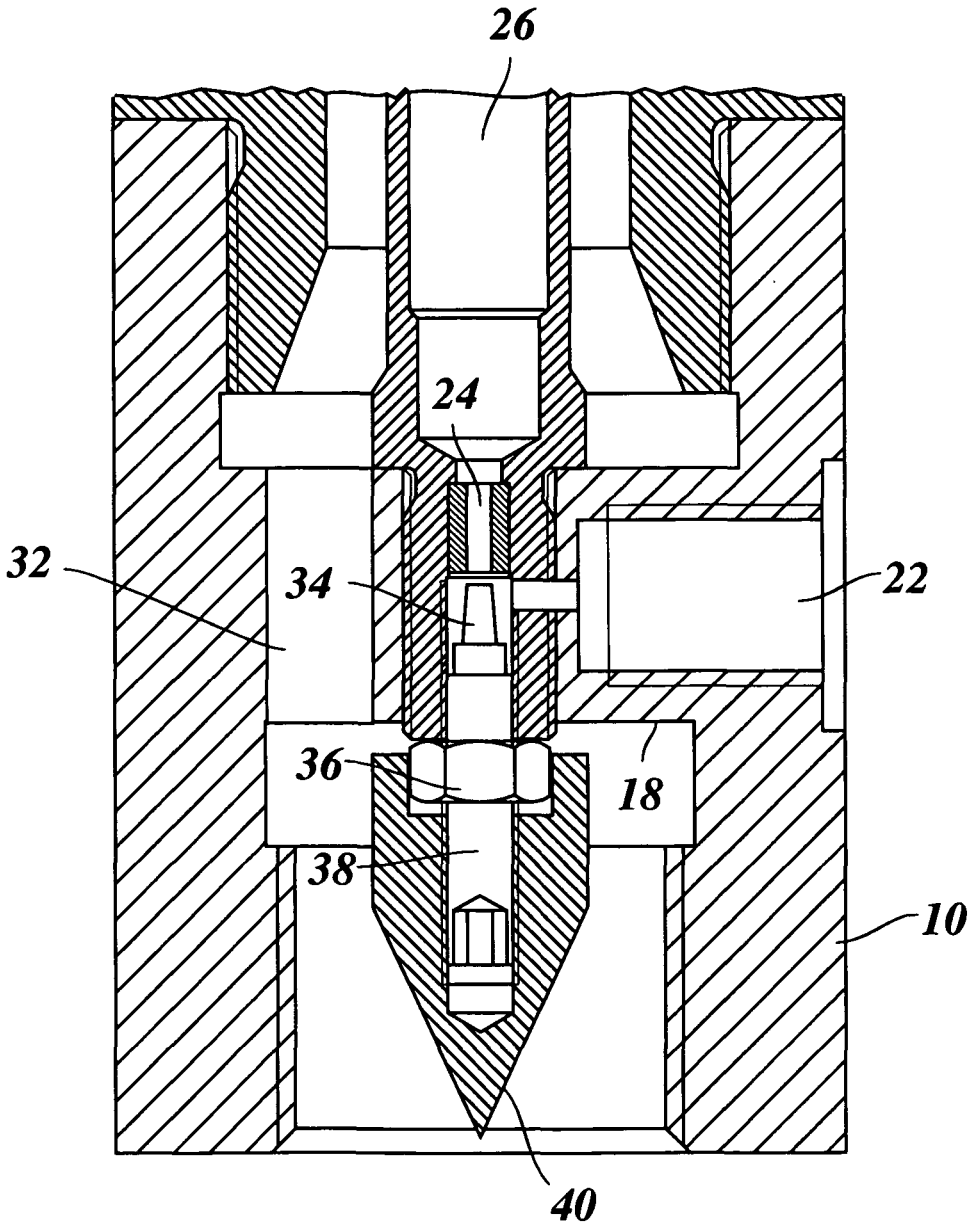
FIG. 3 shows an enlarged axial section of a part of a blasting device according to a modified embodiment.

FIG. 3 illustrates a modified embodiment in which a metering valve 34 for the liquid $CO_2$ is provided at the junction between the supply line 22 and the injection passage 24. A nut 36 and a threaded shaft 38 permit to adjust the position of the metering valve 34, and the nut and the upstream end of the threaded shaft are covered by a streamlined cap 40.

The invention claimed is:

1. A blasting device comprising:

a flow passage for a carrier gas, the flow passage having an axis and a downstream end forming a blasting nozzle, an expansion chamber that is coaxially accommodated in the flow passage, the expansion chamber formed by a pipe having an upstream end, a holder which holds the pipe at the upstream end thereof and through which is passed a flow of carrier gas into the flow passage, and a supply line for liquid CO2, the supply line opening out into the expansion chamber, wherein the supply line extends the flow passage and opens into an injection passage that extends in parallel with the axis of the flow passage and opens into the expansion chamber.

2. The blasting device according to claim 1, wherein the cross-sectional area A of the injection passage and the volume V of the expansion chamber fulfill the relation $V^{1/3}/A^{1/2}>3$.

3. The blasting device according to claim 1, further comprising a squeeze body arranged in the flow passage downstream of the expansion chamber.

4. The blasting device according to claim 3, wherein the squeeze body is tapered at upstream and downstream ends thereof.

5. The blasting device according to claim 3, wherein the squeeze body is a double-cone.

6. The blasting device according to claim 3, wherein the squeeze body projects into the expansion chamber with an upstream end thereof.

7. The blasting device according to claim 3, wherein the flow passage is tapered towards the blasting nozzle, and the squeeze body projects into the tapered portion of the flow passage with a downstream end thereof.

8. The blasting device according to claim 1, further comprising a metering valve provided at a junction between the injection passage and the supply line.

9. The blasting device according to claim 1, wherein the cross-sectional area A of the injection passage and the volume V of the expansion chamber fulfill the relation $V^{1/3}/A^{1/2}>10$.

10. A blasting device comprising:

a flow passage for a carrier gas, the flow passage having an axis and a downstream end forming a blasting nozzle, an expansion chamber that is coaxially accommodated in the flow passage, a supply line for liquid CO2, the supply line opening out into the expansion chamber, and an arrangement which contributes to dry ice production, said arrangement including a squeeze body arranged in the flow passage downstream of the expansion chamber.

11. The blasting device according to claim 10, wherein the squeeze body is tapered at upstream and downstream ends thereof.

12. The blasting device according to claim 10, wherein the squeeze body is a double-cone.

13. The blasting device according to claim 10, wherein the squeeze body projects into the expansion chamber with an upstream end thereof.

14. The blasting device according to claim 10, wherein the flow passage is tapered towards the blasting nozzle, and the squeeze body projects into the tapered portion of the flow passage with a downstream end thereof.

* * * * *

UNITED STATES PATENT AND TRADEMARK OFFICE

CERTIFICATE OF CORRECTION

PATENT NO. : 8,491,354 B2
APPLICATION NO. : 12/744562
DATED : July 23, 2013
INVENTOR(S) : Jens Werner Kipp It is certified that error appears in the above-identified patent and that said Letters Patent is hereby corrected as shown below:

On the title page of the patent, under "(30) Foreign Application Priority Data," the following should be listed:

--(30) Foreign Application Priority Data
December 10, 2007 DE ..... 10 2007 059 628.8
June 6, 2008 DE ..... 10 2008 027 253.1--.

Signed and Sealed this
Thirteenth Day of May, 2014

Michelle K. Lee

Michelle K. Lee
*Deputy Director of the United States Patent and Trademark Office*